US006032287A

United States Patent [19]

Kallas

[11] Patent Number: 6,032,287

[45] Date of Patent: Mar. 7, 2000

[54] CHILD'S CLOTHING GARMENT HAVING CHANGEABLE FRONT PANEL

[76] Inventor: Diane C. Kallas, 10123 Mc Enrue Rd., Swartz Creek, Mich. 48473

[21] Appl. No.: 08/840,100

[22] Filed: Apr. 11, 1997

[51] Int. Cl.[7] ..... A41D 1/00

[52] U.S. Cl. ..... 2/69; 2/74; 2/75; 2/80

[58] Field of Search ..... 2/69, 70, 74, 75, 2/79, 80, 104, 105, 106, 115, 108, 118, 119, 46, 49.1, 49.5, 49.2

[56] References Cited

U.S. PATENT DOCUMENTS

| | | | |
|---|---|---|---|
| 1,095,476 | 5/1914 | Sprague | 2/80 |
| 2,425,635 | 8/1947 | Nitzberg | 2/75 |
| 2,556,039 | 6/1951 | Landert | 2/106 |
| 3,064,265 | 11/1962 | Bridgewaters | 2/75 |
| 3,116,491 | 1/1964 | Previdi et al. | 2/106 |
| 4,754,500 | 7/1988 | Brucato et al. | 2/105 |
| 5,416,928 | 5/1995 | Koenig | 2/244 |
| 5,454,119 | 10/1995 | Thomm | 2/49.2 X |

*Primary Examiner*—Gloria M. Hale

*Attorney, Agent, or Firm*—Reising, Ethington, Barnes, Kisselle, Learman & McCulloch, P.C.

[57] ABSTRACT

A clothing garment is constructed having a lower covering portion that, when worn, is designed to cover the wearer's body generally below the waist, and a permanent back panel that is fixed to the lower covering portion and covers the back of the wearer's torso region. A replaceable front panel is provided having a releasable fastening system that enables it to be attached releasably to the lower body and back portions such that, when worn, the replaceable front panel appears as an integrated panel of the garment, but yet is detachable therefrom and may be interchanged with similar constructed front panels to change the look of the garment or when a front panel becomes soiled. The construction is particularly adapted for children's clothing.

17 Claims, 3 Drawing Sheets

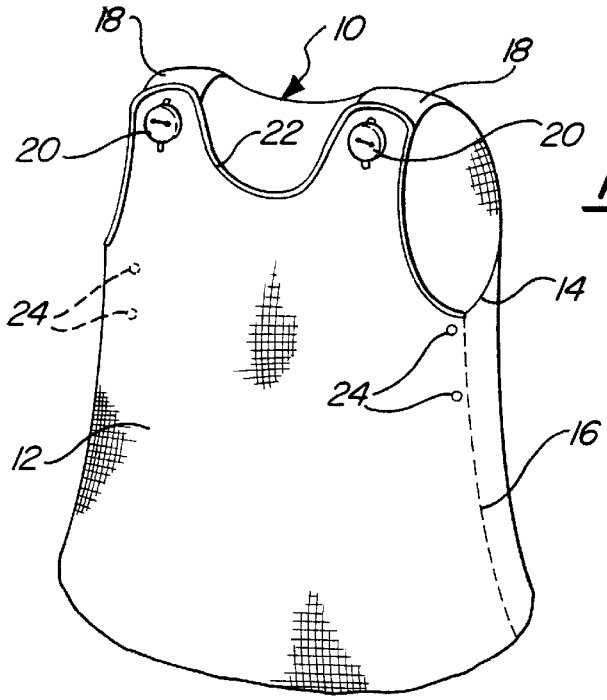
FIG-1
FIG-2
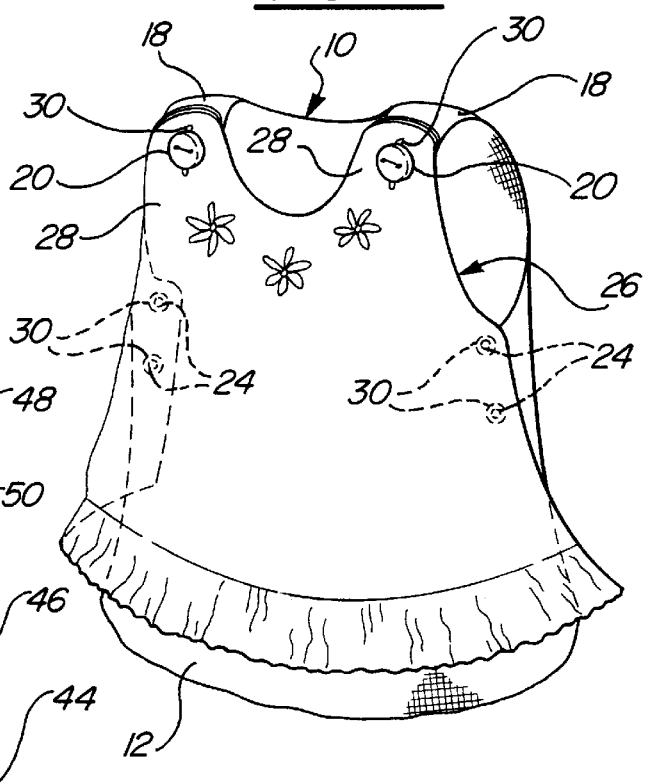
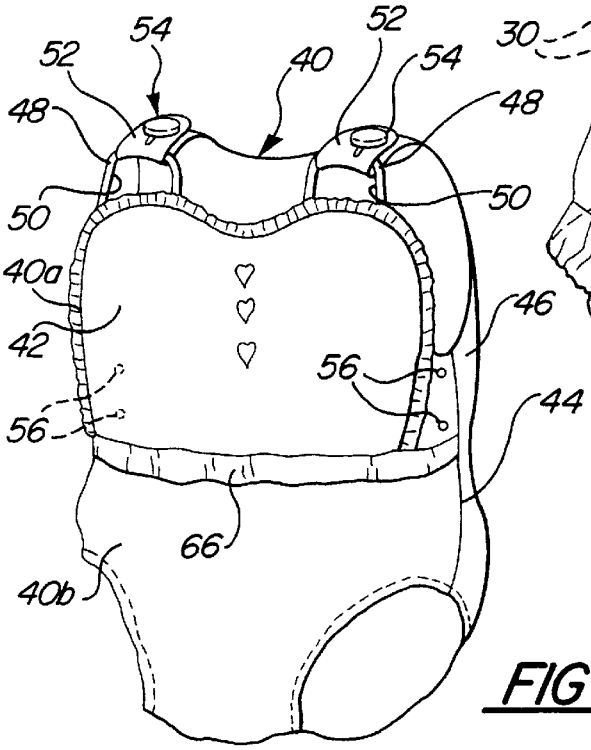
FIG-3

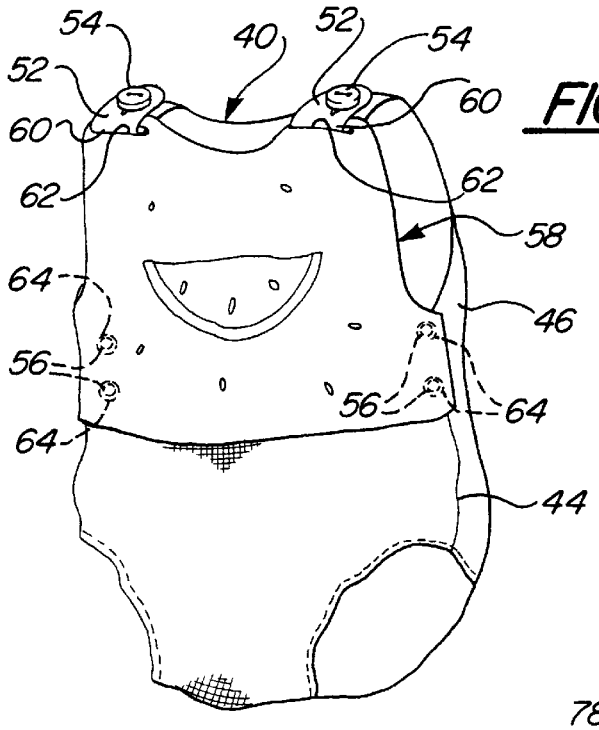
FIG-4
FIG-5
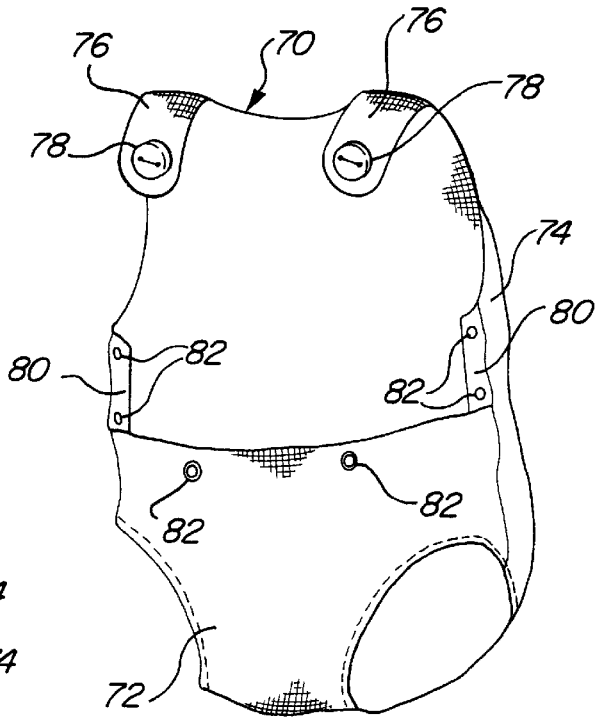
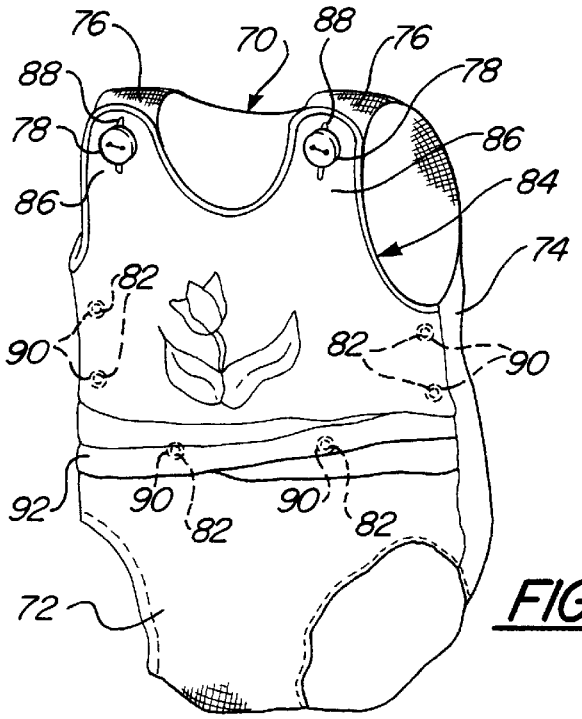
FIG-6

CHILD'S CLOTHING GARMENT HAVING CHANGEABLE FRONT PANEL

BACKGROUND

This invention concerns children's clothing and particularly those of the type commonly worn by infants and toddlers such as one-piece body suits or rompers wherein the pants and top are integrated, and dresses or jumpers likewise of unitary construction designed to cover the upper and mid-section of the child.

SUMMARY OF THE INVENTION

The otherwise conventional garments are constructed to include a replaceable front panel section that, when attached, appears to be a permanent unitary part of the garment.

In the preferred arrangement, the panel attaches to existing buttons on the shoulder straps of the garment and is joined along at least at the side edges to the sides of the existing garment by concealed snaps or equivalent fasteners.

According to one construction, the garment is of a conventional one-piece design having a unitary front panel with buttons at the shoulders but including snaps at the sides to accommodate the attachment of an overlying front panel. According to another construction, the garment per say has a detachable front panel section that can be replaced as needed by other panels.

The replaceability of the front panel is advantageous in that it facilitates a changing of the portion of the garment most often soiled by a small child without requiring the change of the entire outfit. It is particularly beneficial when clothing a small child who is cutting teeth and is prone to getting the front of his or her clothing soiled from drool or in other situations when the child is engaging in activities, such as eating, where the front of the garment is likely to become dirty. According to the invention, all that is required is that the soiled front panel be detached and replaced with a new clean front panel.

The invention is useful also where it is desirable to change the look of an outfit that the child is wearing without having to change the entire outfit. For example, if the child is dressed in a casual sunsuit and it is necessary that the child later be dressed-up a bit to go to church, a family function, or the like, rather than taking an entirely different outfit along, all that is required is that a front panel be on hand that is designed with the appropriate look and at the required time can be attached to the garment.

Other situations where it may be desirable to change the look of the outfit is when the same clothing is desired to be used from one child to the next. In this way, the look of a small boy's outfit can be changed to include a front panel that is more suitable for a girl, and vice versa. Moreover, this enables fewer clothes to be purchased in order to achieve a variety of different looks. Two or three basic outfits could be purchased each having several replaceable front panels fulfilling, at little expense, the entire wardrobe needs of the child.

BRIEF DESCRIPTION OF THE DRAWINGS

These and other objects advantages and features of the present invention will become more readily apparent from the following detailed description when taken together with the accompanying drawings, wherein;

FIG. 1 is a front perspective view of a sundress constructed in accordance with a first presently preferred embodiment of the invention;

FIG. 2 is a view like FIG. 1 but with the replaceable front panel attached;

FIG. 3 is a front perspective view of a one-piece romper constructed according to another embodiment of the invention;

FIG. 4 is a view of the garment of FIG. 3 but with a replaceable front panel attached to change its look;

FIG. 5 is a front perspective view of a garment constructed according to yet another embodiment of the invention;

FIGS. 6 and 7 are views of the garment of FIG. 5 with two different panels attached;

DETAILED DESCRIPTION

Figure 7:
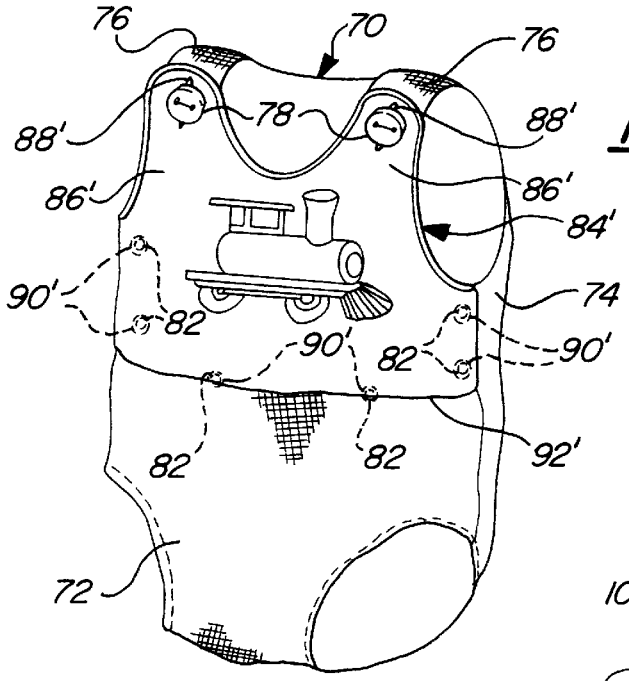

Turning now to the drawings and in particular to FIGS. 1 and 2, a child's garment and in this case a sundress is shown having a permanent front panel 12 sewn to a back panel 14 along seam 16 extending beneath arm openings and provided with shoulder straps 18 carrying buttons 20 which extend about the shoulder region of the user in a shoulder region of the garment and secure the top portion 22 of the panel 12 in conventional manner. Snap closures 24 are sewn in a inconspicuous location on the laterally opposite sides of the garment 10 adjacent the seam 16 and beneath the arm opening. Any of a number of closure types 24 could be utilized but preferably are ones that are small and unnoticeable and may include, for example, clear plastic-type snaps which may be sewn to the exterior of the garment 10. Buttons like those at 20 could also be used. Apart from the closures 24, the garment of FIG. 1 is of conventional construction and would be appear to an observer as being a normal every day one piece dress, which it is.

FIG. 2 illustrates the dress of FIG. 1 shown fitted with a replaceable front panel 26. The panel 26 is much like the permanent front panel 12 except that it is a complete separate piece from the dress 10 and is designed to conform generally in size and shape to that of the panel 12. The panel 26 includes laterally spaced top potions in the form of straps 28 with button holes 30 that enable the straps 28 of the panel 26 to be secured to the shoulder straps 18 of the dress 10 by simply passing the buttons 20 through the button holes 30. The laterally opposite sides portions of the panel 26 are fitted with snap closures 32 preferably mounted on the back side of the panel 26 so to be concealed, which compliment the closures 24 on the garment 10 to effect a connection when brought together to secure the side of the panel 26 releasably to the sides of the garment 10 beneath the arm opening. The replaceable panel 26 could have the same or different look as that of the permanent front panel. By way of example, the dress illustrated in FIG. 1 may be made from a fabric suitable for casual every day wear such as a gingham fabric. A somewhat more frilly and formal panel 26 may be attached in place over the permanent front panel 12 to give the dress a more formal look for special occasions. The replaceable panel 26 is useful too if the child is cutting teeth and is prone to drooling. As the panel 26 becomes soiled, it may be readily removed by unsnapping the sides and unbuttoning the straps 28 and replacing it will a fresh, dry front panel 26. This eliminates the need to fit the child at all times with a bib as is common to protect the front panel of the garment from getting wet from drool.

It will be understood that if the snap closures 24 on the dress 10 are substituted by buttons, then the closures 32 on the panel 26 would be replaced by button holes like those of 30 which would engage the buttons in the same manner that the holes 30 engage the buttons 20 to secure the sides of the panel 26 to the garment 10. In either case, once the panel 26 is secured in place on the dress 10, it appears to an observer that it is in integral part of the dress 10, as opposed to separable attachment. A key part in the construction of the panel 26 that makes it appear as though it was part of the garment 10 is the manner in which it attaches to the existing buttons 20 on the should straps of the garment in the same manner as one would expect to see the top of a permanent front panel 12 attached.

FIGS. 3 and 4 illustrated another embodiment of the invention adopting the same general principles as that of the first embodiment. In this case, the garment 40 is a one-piece sun suit or romper having integrated upper torso and lower pant portions 40*a*, 40*b*, respectively. The upper portion 40*a* includes a permanent front panel 42 joined at side seams 44 to a back panel 46 in similar fashion to the front panels 12, 14 of the dress 10 of FIG. 1. The front panel 42 in this embodiment is provided with a pair of loops 48 providing openings 50 through which free ends of shoulder straps 52 are passed and then doubled over and secured releasably in place by a button or snap closure fitting 54 provided on the straps 52. As with the dress 10, the outfit 40 is provided at its sides with fasteners 56 which may comprise snap closures or buttons.

A replaceable front panel 58 is provided which is sized and shaped to overlie and conceal the permanent front panel 42 therebeneath. The panel 58 is formed at its upper end with slots 60 providing openings 62 sized and arranged to receive the shoulder straps 52 therethrough after which the straps 52 are doubled over and secured by the closures 54 in normal manner to mount the top of the panel 58 in place in the shoulder region of the garment. The sides of the panel 58 have similar mating fasteners 64 which engage the fasteners 56 of the garment 40. Although not shown, similar fasteners may be provided along the bottom edge of the panel 58 for engaging corresponding fasteners provided along the waist line 66 of the garment 40.

The panel 58 can be used in the same manner as described above for the first embodiment and in the illustrated example is shown to be useful in converting a girl's clothing in FIG. 3 to one in FIG. 4 which is suitable for both girls and boys.

FIGS. 5 through 7 illustrate another embodiment of the invention but in this case the garment 70 has no permanent front panel as with the prior embodiments. The garment 70 includes a lower pant portion 72 formed as one piece with an upper back panel 74 terminating at its upper end with pair of shoulder straps 76 carrying buttons 78 adjacent the free ends in the same manner as the straps 18 of the first embodiment and includes mounting flaps 80 at its sides. Connectors 82, such as snap fittings or buttons are located on at least the flaps 80 and preferably also along the top marginal edge of the pants section 72 of the garment.

FIGS. 6 and 7 illustrate two different replaceable panels 84 and 84' that are attachable to the garment 40 to provide a front panel to the garment. The body of the panels 84, 84' extends from the top of the pants section 72 to the shoulder straps 76 and from side to side between the mounting flaps 80. The panels 84, 84' are formed with straps 86, 86' in which buttons holes 88, 88' are formed to engage the buttons 78 in the same manner as described for the first embodiment of FIGS. 1 and 2. The sides and bottom edge of the panels are provided with complimenting connectors 90, 90' which engage the connectors 82 of the garment 70 to secure the panels 84, 84' in place in the same general manner as previously described for the other embodiments. A decorative sash or band 92, 92' may be sewn on the garment 70 or panels 84, 84' to extend across the waist line as shown to conceal therebeneath the attachment line between the panels 84, 84' and the lower pants section 72. As can be seen from a comparison of FIGS. 6 and 7, the garment 70 can be made suitable for wear by a girl (FIG. 6) as well as a boy (FIG. 7) by simply interchanging the panels 84, 84'.

Figure 8:
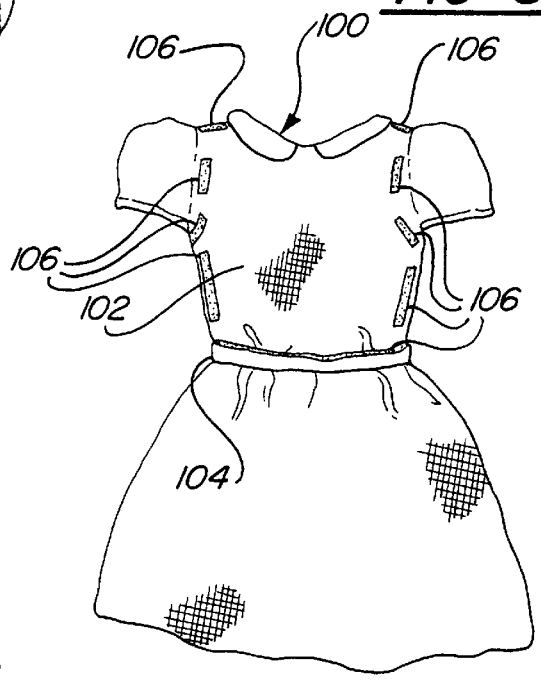
FIG. 8 is a front view of a dress constructed according to yet another embodiment of the invention.
Figure 9:
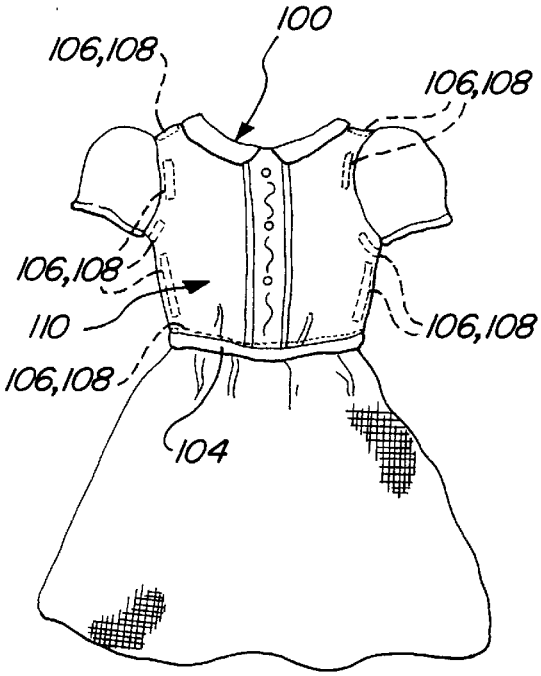
FIG. 9 is a front view of the dress of FIG. 8 but with a replaceable front panel attached.

FIGS. 8 and 9 show yet another embodiment of the invention which in this case is a front panel for a little girl's dress 100. The dress 100 has a permanent front panel 102 which extends to the waist 104 and is provided along its boundary with hook or loop fastener tape 106 which engages complimenting fastening tape 108 on the back side of a replaceable panel 110 to secure the panel 110 to the dress 100, as illustrated in FIG. 9. The panels 110 are readily replaced once the panel becomes soiled if it is desired to change the appearance of the dress. The fasteners, 106, 108 could be other than the hook and loop fastener tape and could include, for example, snap closures or buttons of the type previously described for the other embodiments.

Figure 10:
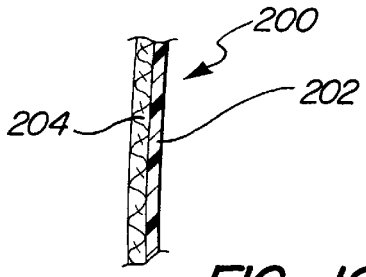
FIG. 10 is a fragmentary cross-sectional view of an alternative garment front panel construction.

Turning now to FIG. 10, an alternative construction of the replaceable panel is shown which may be used in conjunction with any of the previously described embodiments. The panel 200 have a laminated construction, wherein a water-impermeable plastic sheet or backing layer 202 is applied to one side of an adjacent fabric layer 204. The panel 200 may be fixed to the garment in the manner described previously in connection with the other embodiments with the plastic layer 202 facing outwardly to provide a waterproof, wipeable surface which could be used, for example, if the child wearing the garment was eating or teething, without having to change the child's clothes or to cover the clothes with a separate bib. Alternatively, the panel 200 can be applied with the layer 202 serving as a backing layer, such that in the event the outer decorative layer 204 were to become dampened, the underlying permanent front panel would be shielded by the waterproof layer 202 from becoming wet or soiled.

The plastic layer 202 may be heat bonded to the fabric layer 204 in conventional manner or simply sewn together. Where the plastic layer 202 is to face outwardly, it is preferred that it be fabricated of a transparent material, such that the underlying decorative fabric layer 204 is visible through the plastic layer 202, retaining the attractive appearance of the garment.

It is to be understood that other embodiments of the invention which accomplish the same function are incorporated herein within the scope of the claims.

I claim:

1. A clothing garment construction comprising:

a lower covering portion constructed to cover a region of a wearer's body generally below the waist;

a permanent back panel portion fixed to said lower covering portion and constructed to cover the back of the wearer's torso region; and a replaceable front panel attached releasably to said permanent back panel and said lower covering portions and constructed to cover the front torso region of the wearer, said garment having arm openings and said replaceable front panel having laterally opposite side portions disposed along opposite sides of said garment below said arm openings of said garment when applied to said garment, said replaceable front panel having laterally spaced top portions that reside in shoulder regions of said garment when applied to said garment, said side margins including releasable connecting portions engagable with associated releasable connecting portions of said garment provided on said laterally opposite sides thereof below said arm openings, and said top margins including releasable fastening portions engageable with corresponding releaseable fastening portions provided at said shoulder regions of said garment.

2. The garment construction of claim 1 including releasable fasteners joining said releasable front panel to the remaining said portions of the garment.

3. The garment construction of claim 2 wherein said releasable fasteners comprise snap closures.

4. The garment construction of claim 2 wherein said releasable fasteners comprise slot and button closures.

5. The garment of construction of claim 2 wherein said releasable fasteners comprise hook and loop fabric closures.

6. The garment construction of claim 1 including a permanent front panel fixed to said lower covering portion in underlying relation to said replaceable front panel.

7. The garment construction of claim 6 including a sash extending laterally across said lower covering portion of said garment in overlying, covering relation to a lower edge of said replaceable front panel.

8. The garment construction of claim 1 wherein said garment includes a plurality of said replaceable front panels constructed to be interchangeable with one another on said garment.

9. The garment construction of claim 1 wherein said lower covering portion comprises pants.

10. The garment construction of claim 1 wherein said lower covering portions comprises a skirt.

11. The garment construction of claim 1 wherein said replaceable front panel portion is water-impermeable.

12. The garment construction of claim 1 wherein the replaceable front panel portion has a laminated construction including a fabric layer and a water-impermeable plastic layer fixed to said fabric layer.

13. The garment construction of claim 12 wherein said plastic layer faces outwardly and is exposed when said replaceable front panel portion is attached to said garment.

14. The garment construction of claim 13 wherein said exposed plastic layer is transparent enabling said underlying fabric layer to be seen through said plastic layer.

15. A clothing garment construction comprising:

a lower covering portions constructed to cover a region of a wearer's body generally below the waist;

a permanent back panel portion fixed to said lower covering portion and constructed to cover the back of the wearer's torso region; and a replaceable front panel attached releasably to said permanent back panel and said lower covering portions and constructed to cover the front torso region of the wearer, and a sash extending laterally across said lower covering portion of said garment in overlying, covering relation to a lower edge of said replaceable front panel.

16. A clothing garment construction comprising:

a lower covering portion constructed to cover a region of a wearer's body generally below the waist;

a permanent back panel portion fixed to said lower covering portion and constructed to cover the back of the wearer's torso region; and a replaceable front panel attached releasably to said permanent back panel and said lower covering portions and constructed to cover the front torso region of the wearer, wherein the replaceable front panel has a laminated construction including an inner fabric layer and an outer water-impermeable plastic layer fixed to said fabric layer.

17. The garment construction of claim 16 wherein said outer plastic layer is transparent enabling said underlying fabric to be seen through said plastic layer.

* * * * *